US007142805B2

(12) United States Patent
Mizuno et al.

(10) Patent No.: US 7,142,805 B2
(45) Date of Patent: Nov. 28, 2006

(54) MANUAL FEEDING TRAY AND IMAGE FORMING APPARATUS

(75) Inventors: Kyoichi Mizuno, Tama (JP); Kazunobu Miura, Hachioji (JP); Ken Nonaka, Hachioji (JP); Kunihiro Kawachi, Tokyo (JP); Shinichi Kawabata, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 73 days.

(21) Appl. No.: 10/949,245

(22) Filed: Sep. 27, 2004

(65) Prior Publication Data

US 2005/0220519 A1 Oct. 6, 2005

(30) Foreign Application Priority Data

Mar. 30, 2004 (JP) ..... 2004-097568

(51) Int. Cl.
*G03G 15/00* (2006.01)

(52) U.S. Cl. ..... 399/392; 399/388

(58) Field of Classification Search ..... 399/392, 399/393, 389, 388, 377, 361; 271/213, 207, 271/220, 223
See application file for complete search history.

(56) References Cited

U.S. PATENT DOCUMENTS

| | | | | |
|---|---|---|---|---|
| 4,908,673 | A * | 3/1990 | Muramatsu | 399/402 |
| 4,982,945 | A * | 1/1991 | Marasco et al. | 271/213 |
| 5,082,269 | A * | 1/1992 | Hirayama et al. | 271/65 |
| 5,102,112 | A * | 4/1992 | Takahashi | 271/9.08 |
| 5,937,260 | A * | 8/1999 | Taninaka et al. | 399/401 |
| 6,215,970 | B1 * | 4/2001 | Yoshikawa et al. | 399/124 |

FOREIGN PATENT DOCUMENTS

| | | | |
|---|---|---|---|
| JP | 07-144768 | * | 6/1995 |
| JP | 2001-146343 | A | 5/2001 |

* cited by examiner

*Primary Examiner*—Anthony H. Nguyen
(74) *Attorney, Agent, or Firm*—Finnegan, Henderson, Farabow, Garrett & Dunner, L.L.P.

(57) ABSTRACT

Image forming apparatus having a manual feeding tray on which transfer sheet is placed and an image forming device to form images on the transfer sheet fed from the manual feeding tray, wherein the image forming apparatus has a storage section to store the sheet feeding tray with transfer sheet thereon and the manual feeding tray has a supporting member.

21 Claims, 4 Drawing Sheets

MANUAL FEEDING TRAY AND IMAGE FORMING APPARATUS

BACKGROUND

1. Field of the Invention

The present invention relates to an image forming apparatus having a manual feeding tray capable of being closed with transfer sheet sheets placed thereon.

2. Description of Related Art

An image forming apparatus includes a feeding cassette and a manual feeding tray as a sheet feeding means. The feeding cassette is arranged to be drawn from the body of the image forming apparatus. Transfer sheets are placed in the cassette, while the feeding cassette is drawn from the body of the image forming apparatus. When the feeding tray is placed in the body of an image forming apparatus the transfer sheets are ready for feeding. An image forming apparatus, in general, has plural feeding cassettes, each of which can store different sizes of paper sheet.

The manual feeding tray is rotatably attached on the side panel of the image forming apparatus by a hinge, etc. so that the manual feeding tray can be opened and closed. The manual feeding tray is constructed so that when using, the manual feeding tray is opened and transfer sheets are placed thereon; when not using, the manual feeding tray can be retracted. The transfer sheet placed on of the manual feeding tray is lifted up by a lifting board until the front end portion of the transfer sheet reaches to a pick-up roller and fed into the image forming apparatus by being in contact with a pick-up roller. There are two kinds of lifting board. One is a lifting board which is stored together with the manual feeding tray being rotated when the manual feeding tray is stored (For example, referring to Patent Reference 1), and another is a lifting board which is attached to the body of the image forming apparatus and it does not move with the open-close operation of manual feeding tray.

When forming images, an appropriate size of a transfer sheet is selected from either a feeding cassette or a manual feeding tray based on the size of a manuscript, a magnification and a size specified from an operation section.

(Patent Reference No. 1) FIGS. 3 and 4 in Japanese Patent Open to Public, Tokkai 2001-146343.

On the other hand, among various kinds of image forming apparatus, there is an image forming apparatus having a manual feeding tray attached on a side door of the image forming apparatus, which is used for processes such as paper jam and/or maintenances.

In the image forming apparatus having a manual feeding tray on the side door, it is necessary to close the manual feeding tray when opening the door to fix paper-jam and/or to conduct maintenances. Because when trying to open the door with the manual feeding tray left open, the manual feeding tray hits a wall, etc. and the door cannot be fully opened. There is a problem that it is not easy to conduct a paper jam process to remove jammed paper and/or maintenances when the door cannot be fully open due to the fact that the manual feeding tray becomes an obstacle. In order to make it possible to fully open the door, an image forming apparatus has to be installed by taking account of the space necessary for the door opening.

In the image forming apparatus of Patent Reference No. 1, it is impossible to close the manual feeding tray with transfer sheet thereon since there is no space to store the transfer sheet in the manual feeding tray in a case of a certain model of image forming apparatus. Even though it is possible to close the manual feeding tray, the transfer sheet gets damaged. In an image forming apparatus having the lifting board therein, when the manual feeding tray is closed, the transfer sheet is bent and curled at the portion where the lifting board is in contact with the transfer sheet. Accordingly, when conducting a process to remove jammed papers and/or execute maintenances, before closing the manual feeding tray, transfer sheets on the manual feeding tray should be removed and after opening the manual feeding tray, the transfer sheets should be placed back on the manual feeding tray. In other words, there is a problem that it takes time and efforts to conduct additional works other than a paper jam processing and/or maintenance.

The object of the present invention is to provide a manual feeding tray capable to be closed with transfer sheet thereon.

SUMMARY (Embodiment 1)

In order to attain the object of the present invention, in accordance with one aspect of the present invention, provide is an image forming apparatus having a manual feeding tray, on which transfer sheet sheets are placed, attached so that it can swings between a sheet feeding position and a storage position and an image forming section to form images on the transfer sheet fed from the manual feeding tray, the image forming apparatus comprising:

the manual feeding tray;

a storage section to store transfer sheet sheets placed on the manual sheet feeding; and a supporting member to support transfer sheet, the supporting member swings along with the swing of the manual feeding tray when the manual feeding tray is stored in a storing space.

(Embodiment 2)

In accordance with another aspect of the present invention, provided is the image forming apparatus, wherein the manual feeding tray includes a sheet holding member when storing the manual feeding tray into the storing space.

(Embodiment 3)

In accordance with another aspect of the present invention, provide is the image forming apparatus, wherein the length of the sheet holding member is equal to and more than one half of a maximum length of the transform paper in the feeding direction, which can pass through the image forming apparatus from the manual feeding tray.

(Embodiment 4)

In accordance with another aspect of the present invention provided is the image forming apparatus having the supporting member attached in the manual feeding tray.

(Embodiment 5)

The image forming apparatus has an open-close door capable of opening and closing, and the manual feeding tray and the storage section are provides therein.

(Embodiment 6)

The image forming apparatus includes the open-close fulcrum of the open-close door positioned at a rear side when facing to the front surface of the apparatus.

The image forming apparatus of Embodiment 1 includes a manual feeding tray and an image forming section. The manual feeding tray is provided so that it can be stored in the storage section provided in the image forming apparatus together with transfer sheet set in the tray. In order to prevent the transfer sheet from dropping from the tray a supporting member is provided. According to this construction, it becomes possible to open-close the manual feeding tray together with transfer sheet being placed thereon.

The image forming apparatus of Embodiment 2 includes the supporting member in the manual feeding tray. Since when closing the manual feeding tray, the sheet holding member keeps transparent paper straight, transfer sheet does not get a peculiarity such as a slack, etc. Also it becomes possible to prevent the top portion of transfer sheet from bending down and getting a peculiarity.

In the image forming apparatus of Embodiment 3, it becomes possible to prevent transfer sheet from getting a peculiarity by setting the length of the sheet holding member more than one half of the maximum size of transfer sheet, which can pass through the manual feeding tray.

According to Embodiment 4 above, since the supporting member is provided in the manual feeding tray, there is no reason to provide another mechanism to swing the supporting member. This makes the structure of the image forming apparatus simple.

According to Embodiment 5, since the open-close door has a manual feeding tray and a storage section thereon, it is possible to improve the operability when conducting maintenances or removing jammed paper sheets by opening the open-close door. Also it becomes possible to save space for the installation of the image forming apparatus by taking account of the operability of the image forming apparatus.

According to the Embodiment 6, since the open-close fulcrum of the open-close door is provided in the rear side facing to the front surface of the image forming apparatus direction, it also contributes to improve the operability in the apparatus having the same construction when conducting maintenance or removing jammed paper by opening the open-close door. It also contributes to save space for the installation of the apparatus by taking account of the operability of the image forming apparatus.

DETAIL DESCRIPTION OF THE INVENTION

Figure 1:
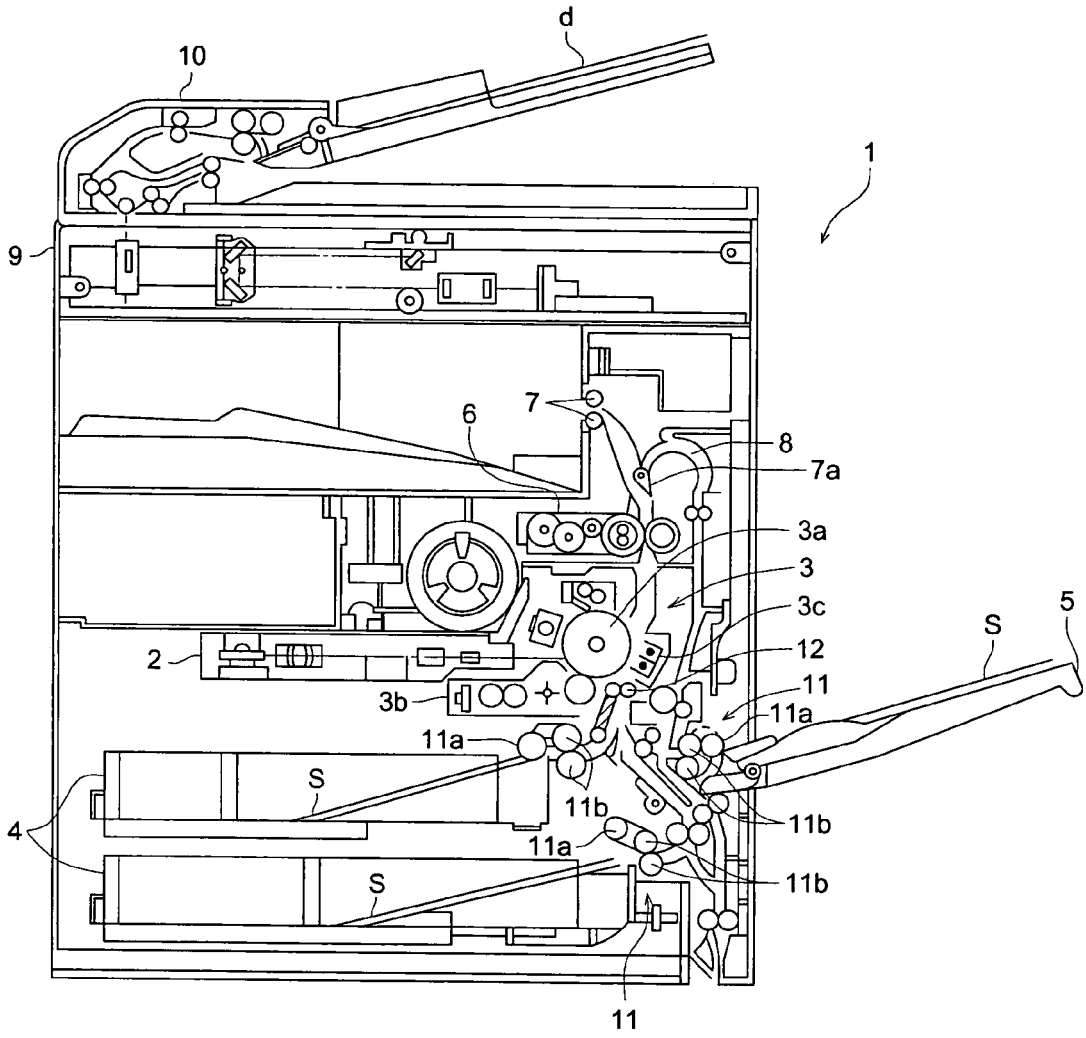
FIG. 1 is a configuration of an image forming apparatus.

The image forming apparatus of the present invention will be explained by using drawings. FIG. 1 shows a configuration of the image forming apparatus of the present invention. Image forming apparatus 1 includes image writer 2, image forming device 3, feeding cassette 4, manual feeding tray 5, image fixing device 6, ejecting rollers 7 and re-conveyance device 8 for duplex copying. And manuscript reader 9 and manuscript conveyer 10 are provided on the upper portion of image forming apparatus 1.

Manuscript "d" is conveyed on a platen-glass, etc. provided upper portion of manuscript reader 9 by manuscript conveyer 10 and a single or dual side surface images of manuscript "d" are read by an optical unit as analog signals. The read-analog signals are sent to image writer via analog processing, A/D (Analog to Digital conversion), shading correction and image signal compression process, etc. (Not shown).

Image writer 2 forms image data being sent into electrostatic latent images on image holding device 3*a*. This is done by irradiating output laser beams from a semiconductor laser diode provided in image writer 2 to image holding device 3*a* uniformly charged with electrostatic charges. Formed electrostatic latent images are developed into toner images by developing device 3*b*, transferred to transfer sheet S conveyed from feeding cassette 4 by transferring device 3*c* and fixed on transfer sheet S by fixing device 6. And in the case of a duplex copy mode paper S, transfer sheet S is turned around via re-conveyance device 8 and conveyed to image forming device 3 again. When finishing image formation, ejecting rollers 7 ejects transfer sheet S to the outside of image forming apparatus 1.

Feeding cassette 4 and manual feeding tray 5 forms a sheet feeding apparatus together with sheet feeding device 11 to take out a piece of paper from transfer sheet S. Sheet feeding device 11 has pickup roller 11*a* and anti-duplex conveyance rollers 11*b*. Pickup roller 11*a* takes out a transfer sheet located on the top of transfer sheet S stored in feeding cassette 4. After anti-duplex conveyance rollers 11*b* deal with and convey them to image forming device 3. Registration roller 12 is provided right before image forming device 3 to correct the alignment of the front edge of transfer sheet S and to adjust a transfer timing.

Figure 2:
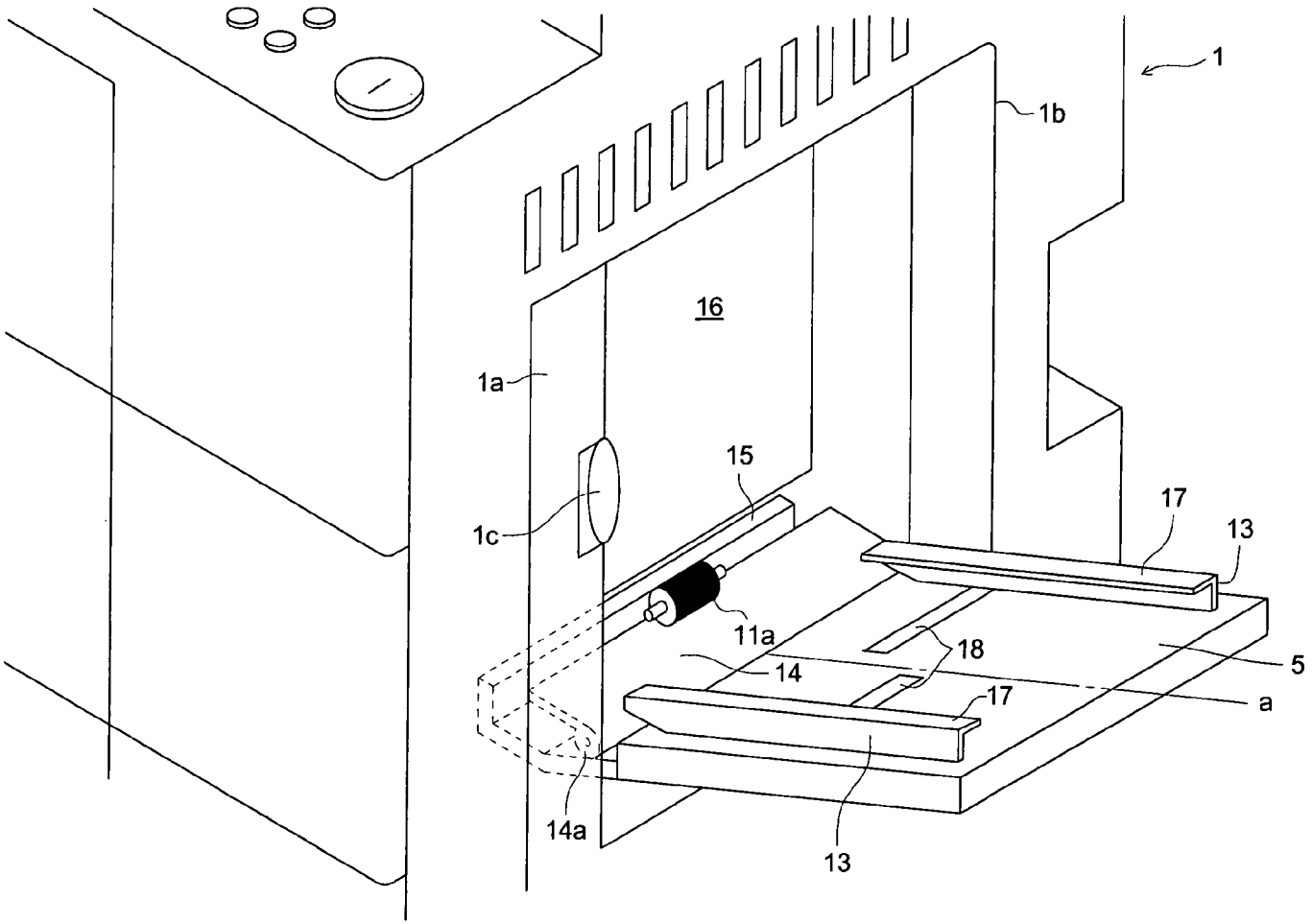
FIG. 2 is a magnified perspective view of the periphery of a manual feeding tray.

FIG. 2 is a magnified perspective view showing the periphery of a manual feeding tray. Manual feeding tray 5 is made of resin, etc. and the size of manual feeding tray 5 is larger than the size of the maximum transfer sheet. On the top of sheet feeding tray 5, side boards 13 are provided vertically rising against sheet feeding tray 5 and on the top of side boards 13, transfer sheet holding members 17 are provided vertically against sheet feeding tray 5. Side boards 13 are arranged so as to freely slide along grooves 18 provided in the direction which crosses the conveyance direction of transfer sheet S at right angle. When either one of two slide boards 13 slides, another slide board 13 slides so that the distances from center line "a" to each board 13 are equal.

In an embodiment, image forming apparatus 1, shown in FIG. 2, manual feeding tray 5 is provided in open-close door 1*a*. Open-close door 1*a* is arranged so as to freely swing by hinge 1*b* provided in the rear side of image forming apparatus 1. Operator can open open-close door 1*a* toward the rear side of the drawing on hinge 1*b* as a fulcrum by gripping handle 1*c* provided front side of open-close door 1*a*. It is possible to remove jammed paper sheets and to conduct maintenances, etc. by opening open-close door 1*a*.

In order to place transfer sheet S on manual feeding tray 5, firstly, slide side boards 13 so that a distance between both side boards 13 is expanded and place transfer sheet S between both side boards 13. Secondly, slide side boards 13 toward inside so that the distance between both side boards 13 is narrowed and transfer sheet is nipped in from both side by side boards 13, and align the edge of transfer sheet S. A bundle of transfer sheet S is placed between the upper side of manual feeding tray 5 and transfer sheet holding members 17.

There is provided lifting board 14 which contacts transfer sheet S to pickup roller 11*a* under pickup roller 14. Lifting board 14 is provided on manual feeding tray 5 via shaft 14*a* so that lifting board 14 freely swings, and it is moved up and down on shaft 14*a* by a driving device (not shown). A transfer sheet located on the top of transfer sheet S placed on manual feeding tray 5 touches pickup roller 11*a* by moving lifting board 14 upward and pickup roller 11*a* feeds it to image forming device 3.

Supporting member 15 vertically rises at the point, which is closer to image forming device 3 than lifting board 14, is provided under lifting board 14.

And storage section 16 is provided to store manual feeding tray 5 and transfer sheet S placed thereon when closing manual feeding tray 5, over pickup roller 11*a*.

Figure 3:
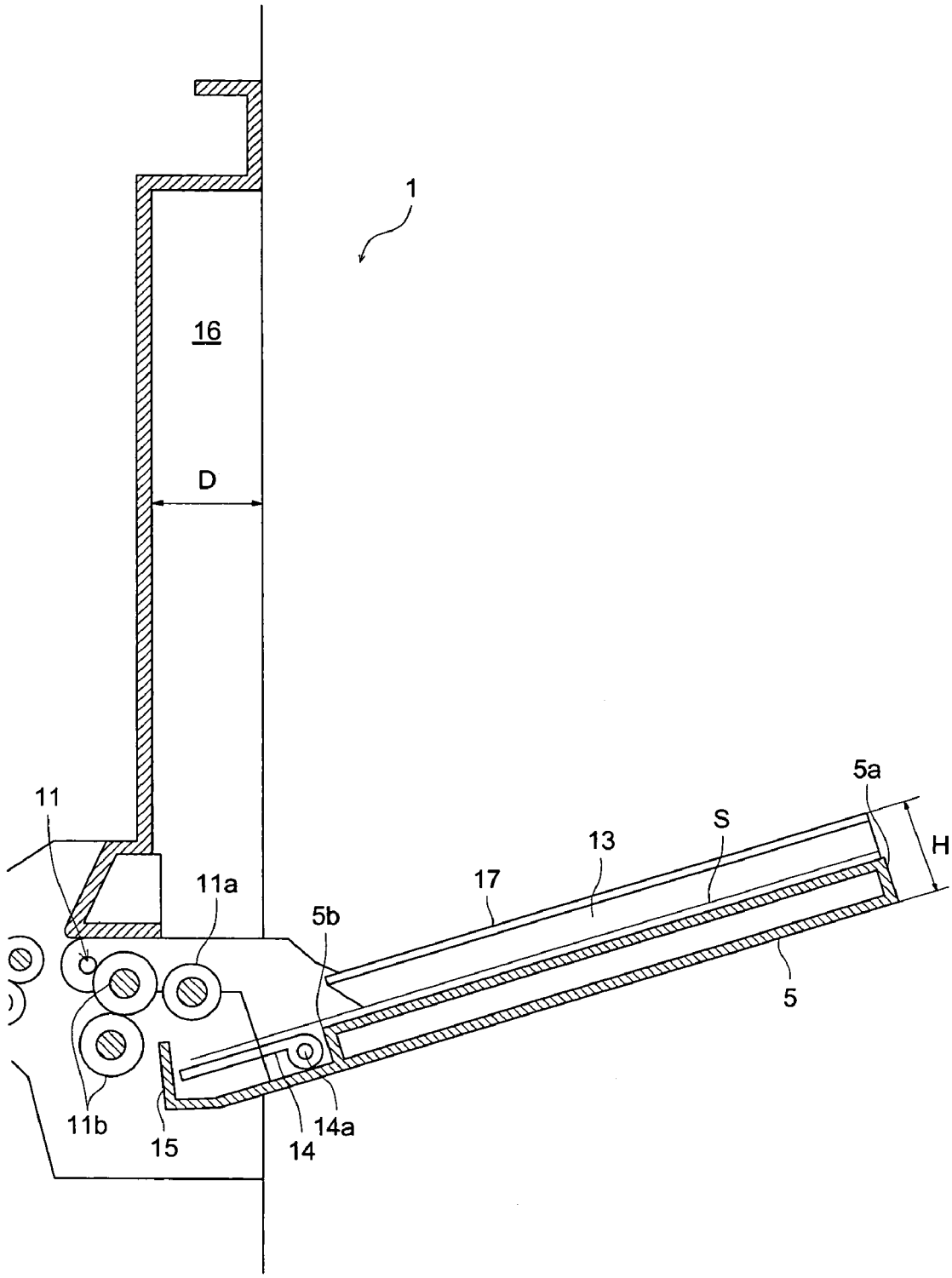
FIG. 3 shows the state of a manual feeding tray, which is opened.

FIG. 3 shows the state of the manual feeding tray 5 which is left open. The length of side board 13 is substantially the same length from edge 5*b* positioned at lifting board 14 side of manual feeding tray 5 to another edge 5*a*. However, the present invention is not limited to the embodiment as shown above. The length of side boards 13 should be more than one half of the length of the maximum size of transfer sheet S in the conveyance direction which can be fed by manual feeding tray 5. However it is preferable that the length of side boards 13 is the length corresponding to the length in the feeding direction of the maximum size of paper sheet. The shape of storage section 16 to store manual feeding tray 5 is concavity provided in image forming apparatus 1. Depth D of storage section 16 is equal to or more than H, which is equal to the sum of the thickness of manual feeding tray 5 and the height of side boards 13.

Figure 4:
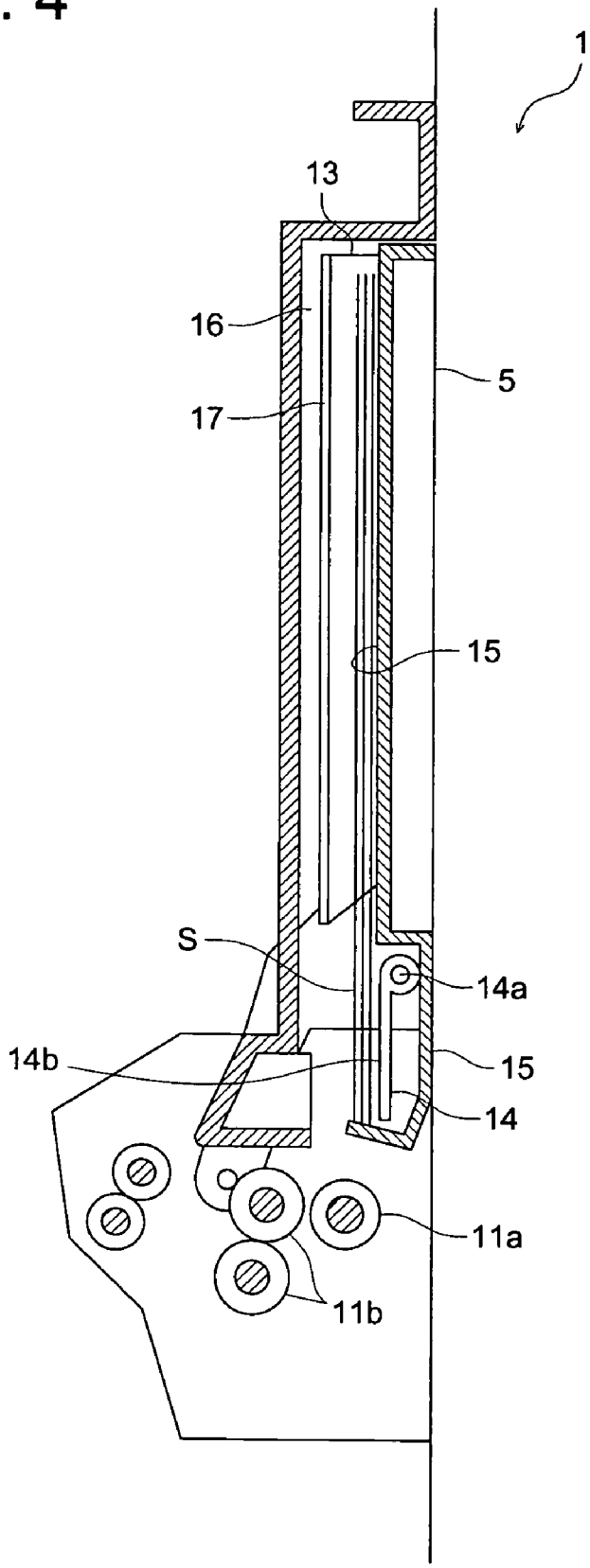
FIG. 4 shows the state of a manual feeding tray, which is closed.

FIG. 4 shows the state of the manual feeding tray which is left closed. Since the depth of storage section 16 is more than H which is the sum of the thickness of manual feeding tray and the height of side boards 13, manual feeding tray is completely stored in storage section 16. Accordingly, since lifting board 14 is attached to manual feeding tray 5, lifting board 14 is stored together with manual feeding tray 5 into storage section 16 when manual feeding tray 5 is closed. When closing, since top surface 14*b* of lifting board 14 and top surface 5*c* of manual feeding tray 5 are on the same plane, transfer sheet S is stored without a bend. And since supporting member 15 holds the lower edge of transfer sheet, supporting member 15 prevents transfer sheet S from dropping in image forming apparatus 1. Further, transfer sheet holding member 17 prevents the top edge of transfer sheet S from being bent. Since transfer sheet holding member 17 keeps transfer sheet S to be straight, transfer sheet does not get a slack peculiarity, etc.

Accordingly, when manual feeding tray 5 is closed, transfer sheet S does not get scratches or a bent peculiarity. And transfer sheet S does not drop into image forming apparatus 1.

Yet, lifting board 14 is attached in manual feeding tray in the present invention, the present invention does not limit it to the example of the embodiment. The present invention is applicable to a color image forming apparatus.

We claim:

1. An image forming apparatus comprising:

a manual feeding tray to feed transfer sheets placed thereon which is arranged so as to swing from a first position where transfer sheets are fed to a second position where the manual feeding tray is stored;

an image forming device to form images on transfer sheets fed from the manual feeding tray;

a storage section having a space to store the manual feeding tray and transfer sheets fed from the manual feeding tray; and a supporting member to support transfer sheets provided at one end of the manual feeding tray, wherein at the second position, the manual feeding tray supports transfer sheets in a straight line and the supporting member holds the lower edge of transfer sheets.

2. The image forming apparatus of claim 1, wherein the manual feeding tray has a sheet holding member to hold transfer sheets when storing the manual feeding tray in the storing space.

3. The image forming apparatus of claim 2 wherein, a length of the sheet holding member is equal to or more than one half of a maximum length in a feeding direction of the transfer sheets.

4. The image forming apparatus of claim 1 wherein, the supporting member is provided in the manual feeding tray.

5. The image forming apparatus of claim 2 wherein, the supporting member is provided in the manual feeding tray.

6. The image forming apparatus of claim 3 wherein, the supporting member is provided in the manual feeding tray.

7. The image forming apparatus of claim 1 further comprising an open-close door having the manual feeding tray and the storage section provided therein.

8. The image forming apparatus of claim 2 further comprising an open-close door having the manual feeding tray and the storage section provided therein.

9. The image forming apparatus of claim 3 further comprising an open-close door having the manual feeding tray and the storage section provided therein.

10. The image forming apparatus of claim 4 further comprising an open-close door having the manual feeding tray and the storage section provided therein.

11. The image forming apparatus of claim 5 further comprising an open-close door having the manual feeding tray and the storage section provided therein.

12. The image forming apparatus of claim 6 further comprising an open-close door having the manual feeding tray and the storage section provided therein.

13. The image forming apparatus of claim 7 further comprising an open-close fulcrum of the open-close door positioned at a rear side when facing to the front surface of the image forming apparatus.

14. The image forming apparatus of claim 8 further comprising an open-close fulcrum of the open-close door positioned at a rear side when facing to the front surface of the image forming apparatus.

15. The image forming apparatus of claim 9 further comprising an open-close fulcrum of the open-close door positioned at a rear side when facing to the front surface of the image forming apparatus.

16. The image forming apparatus of claim 10 further comprising an open-close fulcrum of the open-close door positioned at a rear side when facing to the front surface of the image forming apparatus.

17. The image forming apparatus of claim 11 further comprising an open-close fulcrum of the open-close door positioned at a rear side when facing to the front surface of the image forming apparatus.

18. The image forming apparatus of claim 12 further comprising an open-close fulcrum of the open-close door positioned at a rear side when facing to the front surface of the image forming apparatus.

19. The image forming apparatus of claim 1, wherein a shape of the manual feeding tray which extends from one end to the other end of the manual feeding tray remains the same both in the first position and the second position.

20. The image forming apparatus of claim 1, wherein the supporting member prevents transfer sheets from dropping in the image forming apparatus.

21. The image forming apparatus of claim 1, further comprising a lifting member provided to the manual feeding tray pivotally to lift up transfer sheets.

* * * * *